US005245775A

United States Patent [19]

Goserud

[11] Patent Number: 5,245,775

[45] Date of Patent: Sep. 21, 1993

[54] HOLDER FOR PROTECTIVELY DISPLAYING FLAT OBJECTS

[76] Inventor: J. Thomas Goserud, 13818 Sutters Mill Road, Midlothian, Va. 23112

[21] Appl. No.: 761,513

[22] Filed: Sep. 18, 1991

[51] Int. Cl.[5] ..... G09F 03/18

[52] U.S. Cl. ..... 40/642; 40/158.1

[58] Field of Search ..... 40/661, 158.1, 649, 40/156, 159.2

[56] References Cited

U.S. PATENT DOCUMENTS

| | | | |
|---|---|---|---|
| 318,908 | 5/1885 | Johnson | 40/156 |
| 3,707,053 | 12/1972 | Itano | 40/158.1 |
| 4,145,829 | 3/1979 | Peltier | 40/158.1 |
| 4,413,434 | 11/1983 | Rupert et al. | 40/661 |
| 4,682,430 | 7/1987 | Ramsay | 40/649 X |
| 5,074,067 | 12/1991 | Cohart | 40/158.1 |

*Primary Examiner*—Kenneth J. Dorner
*Assistant Examiner*—J. Bonifanti
*Attorney, Agent, or Firm*—Norman B. Rainer

[57] ABSTRACT

A holder for protectively displaying flat collectible items such as sports cards and photographs is made of a jacket and an insert member shaped to slide into and closely fit within the jacket. The insert member, fabricated of opaque sheet material, contains a centered rectangular aperture which accommodates a flat collectible item. The jacket is constructed from two identical sheets of semi-rigid non-breakable transparent plastic bounded by four straight edges in a rectangular configuration, and bonded together at three edges.

9 Claims, 2 Drawing Sheets

HOLDER FOR PROTECTIVELY DISPLAYING FLAT OBJECTS

BACKGROUND OF THE INVENTION

1. Field of the Invention

This invention concerns a holder for protecting and displaying flat objects, and more particularly relates to a holder which visually enhances both sides of collectible sports cards.

2. Description of the Prior Art

It is often sought to protectively display a flat rectangular object such as a photograph or collectible sports card with the addition of a surrounding border that enhances the appearance of the object. In the case of collectible sports cards, it is important to be able to view both sides of the card.

Sports cards are generally of elongated rectangular shape, and depict professional players in sports such as baseball, football, basketball, hockey, soccer, wrestling, tennis, golf, auto racing, and other sports. The depiction is generally in the form of photographs which appear on both faces of the card. Performance statistics, team affiliation, special accomplishments, and other information relevant to the player and/or sport may also be printed on either or both faces of the card.

The economic value of the card is dependent in part upon its physical condition. Accordingly, any display-type holder should also protect the card from the affects of handling and exposure to air, humidity and strong light.

Although protective display holders for collectible cards have earlier been disclosed, they are in general of complicated construction, expensive, or difficult to utilize. Most such earlier holders do little to enhance the appearance of the card.

It is accordingly an object of the present invention to provide a holder device for protectively displaying flat objects.

It is another object of this invention to provide a holder as in the foregoing object which is easy to use.

It is a further object of the invention to provide a holder of the aforesaid nature which enhances the appearance of one or both surfaces of the flat object, and is of durable, simple construction amenable to low cost manufacture.

These objects and other objects and advantages of the invention will be apparent from the following description.

SUMMARY OF THE INVENTION

The above and other beneficial objects and advantages are accomplished in accordance with the present invention by a holder comprised of:

a) a jacket formed from two identical sheets of semi-rigid non-breakable transparent plastic bounded by four straight edges in a rectangular configuration elongated upon a center axis, said sheets disposed one atop the other and sealed together along three edges by bonding to intervening transparent plastic spacer strips of uniform thickness disposed contiguously with said edges and parallel thereto, whereby the unsealed fourth edges define an entrance opening to an enclosure bounded by said spacer strips and said sheets, and b) an insert member comprised of a piece of opaque sheet material slidably insertable through said opening, having a thickness and outer perimeter adapted to perfectly fill said enclosure, and having a substantially centered aperture of elongated rectangular configuration having a long axis disposed coaxially with the long axis of the jacket.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 2:
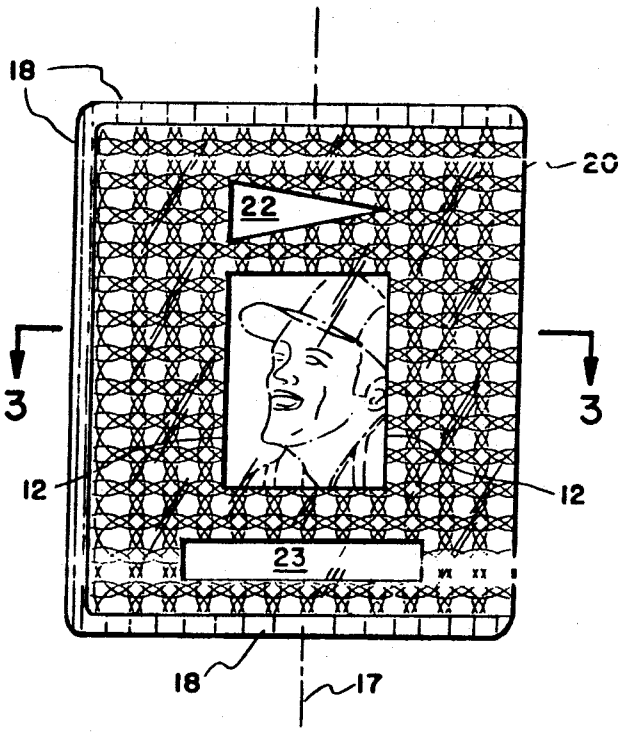
FIG. 2 is a top plan view of the holder of FIG. 1 shown holding a sports car.
Figure 1:
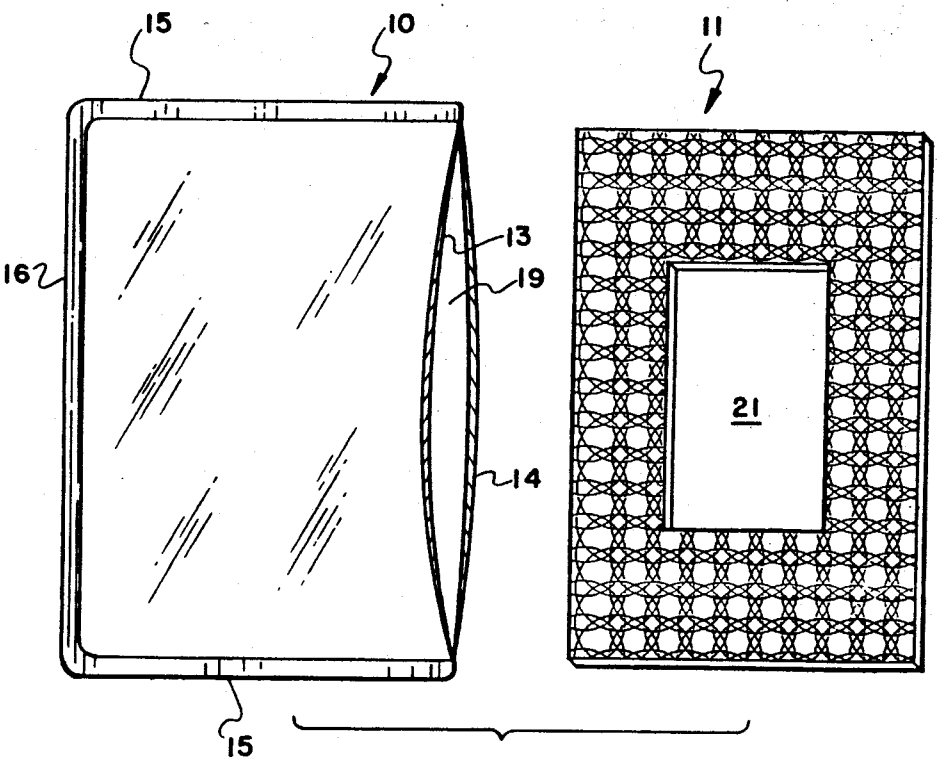
FIG. 1 is an exploded front perspective view of an embodiment of the holder of the present invention.
Figure 4:
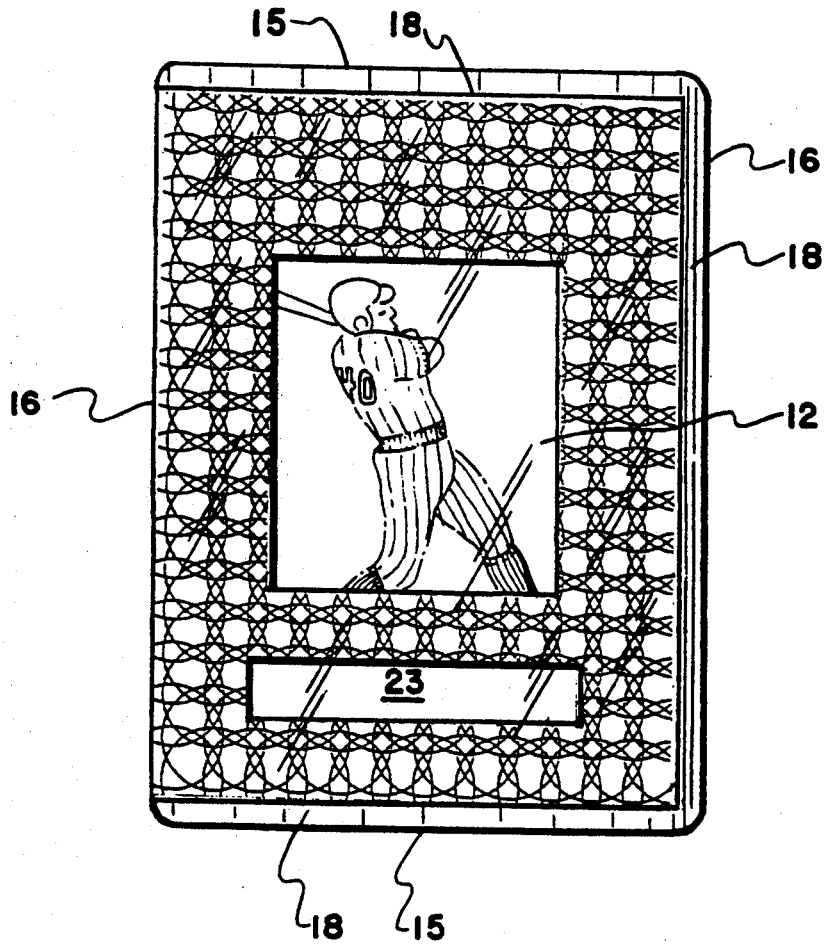
FIG. 4 is a rear view of the holder of FIG. 1.
Figure 3:
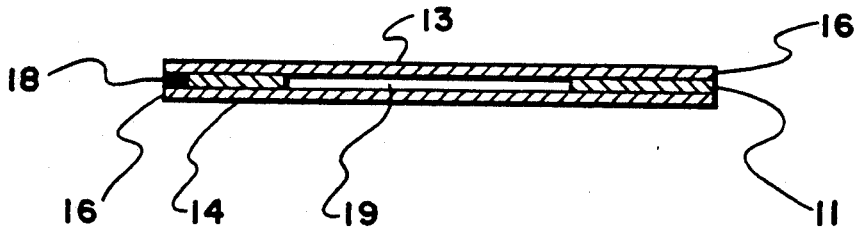
FIG. 3 is a sectional view taken upon the line 3—3 of FIG. 2.

Referring to FIGS. 1-4, an embodiment of the holder of the present invention is shown comprised of jacket 10 and insert member 11 adapted to slidably fit into said jacket. A sports card 12 is shown properly emplaced within the holder.

Jacket 10 is formed from identical top and bottom sheets 13 and 14, respectively, fabricated of semi-rigid non-breakable transparent plastic. Suitable plastics include plasticized polyvinyl chloride, polycarbonate, polyacrylic esters, and ionomer resins. Said sheets are of elongated rectangular configuration, bounded by opposed short edges 15 and long edges 16, and having a center axis 17 parallel to said long edges and midway therebetween. Said sheets are disposed one atop the other and sealed together by bonding to intervening transparent plastic spacer strips 18 placed in contiguous relationship to three of said edges. Said spacer strips are of uniform thickness, measured in the direction orthogonal to said sheets, and are of uniform width, measured in the plane of said sheets.

The sheets will typically have a uniform thickness in the range of about 0.2 to 0.1 millimeter. The length of the jacket, measured orthogonally between short edges 15 will be in the range of about 13 to 20 cm. The width of the jacket, measured between long edges 16 will be in the range of about 9 to 14 cm. The ratio of length to width is preferably within the range of about 1.1 to 1.6.

The sealed sheets define an enclosure 19 bounded by said sheets and spacer strips. The unsealed fourth edges of said sheets define an entrance opening 20 providing access to enclosure 19. The thickness of the spacer strips is between about 0.2 mm and 1.0 mm. The sealing of the sheets to the spacer strips may be achieved by adhesives or cohesive binding techniques which include ultrasonic welding, microwave heating and the use of heated platens or rollers.

Insert member 11 is a monolithic piece of semi-rigid sheet material having a uniform thickness comparable to the thickness of the spacer strips, and an outer rectangular perimeter dimensioned to exactly fit within said enclosure. An aperture 21 of elongated rectangular configuration is substantially centrally disposed within said insert member in a manner wherein the long axis of aperture 21 becomes coaxially disposed with center axis 17 of jacket 10 when said insert member is properly seated within said jacket. Insert member 11 is preferably fabricated of plastic material whose front and rear surfaces are modified so as to impart special optical or illusory effects. In particular, the preferred specialized optical effect is one which produces a perception of depth. Modified surfaces that provide suitable optical illusions are described for example in U.S. Pat. No. 3,357,772; 3,357,773 and 3,893,795. In general, the illusory effects are produced in an otherwise transparent plastic sheet by curvilinear lens-like embossments disposed on the front surface of the sheet and a multiplicity of closely spaced reflective embossments on the rear surface.

The insert member serves the following several purposes: A) it facilitates the sliding insertion of a card or photograph into the jacket, B) it eliminates the need to grasp the card or photograph by the fingers, which would leave fingerprints that may cause long-term deterioration, C) it automatically centers the card within the jacket, D) it functions as a separator to prevent sheets 13 and 14 from pressing hard upon the surfaces of the card, and E) in the preferred embodiment, it causes the card to appear as though it is either recessed behind or floating atop the plane of the holder when viewed from above top sheet 13.

Aperture 21 is cut so as to exactly fit the card, photograph or other flat collectible item. Other flat items may be placed within the jacket either by being attached to the faces of the insert member, or by being recessed into auxiliary apertures fashioned into the insert member. For example, a pennant or flag 22 may be employed, or rectangular cards or papers 23 containing printed indicia associated with the player whose picture appears on the card. By virtue of the aforesaid components and their interaction, the flat collectible item is protectively enclosed in a holder that enhances the appearance of both sides of the item. The assembled holder, containing the flat collectible item is sufficiently rigid so that it can be supported in a substantially upright position by a stand. In view of the relatively flat nature of the holder, it can be stored in stacks that occupy relatively little space.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A holder for collectable flat objects comprising:

a) a jacket formed from two identical sheets of semi-rigid non-breakable transparent plastic bounded by four straight edges in a rectangular configuration elongated upon a center axis, said sheets disposed one atop the other and sealed together along three edges by bonding to intervening spacer strips of uniform thickness disposed contiguously with said edges and parallel thereto, whereby the unsealed fourth edges define an entrance opening to an enclosure bounded by said spacer strips and sheets, and b) an insert member comprised of a piece of sheet material slidably insertable through said opening, having a thickness and outer perimeter adapted to perfectly fill said enclosure, and having a substantially centered aperture of elongated rectangular configuration having a long axis disposed coaxially with the center axis of the jacket, said insert member having front and rear surfaces, at least one of said surfaces providing an optical illusory effect producing a perception of depth.

2. The holder of claim 1 wherein the rectangular configuration of said sheets is comprised of opposed short edges and opposed long edges, and said sheets are sealed together along one long edge and two short edges, thereby causing said entrance opening, defined by the unsealed fourth edges, to be along said long edges.

3. The holder of claim 2 wherein said sheets have a uniform thickness of between about 0.2 and 1.0 millimeter.

4. The holder of claim 3 wherein the length of the jacket, measured orthogonally between said short edges is in the range of about 13 to 20 centimeters, and the width of the jacket, measured orthogonally between said long edges, is in the range of about 9 to 14 centimeters.

5. The holder of claim 4 wherein the ratio of length to width is within the range of about 1.1 to 1.6.

6. The holder of claim 5 wherein the thickness of said spacer strips is between about 0.2 and 1.0 millimeter.

7. The holder claim 1 wherein said illusory effect is produced in an otherwise transparent plastic sheet by curvilinear lens-like embossments disposed on the front surface of the sheet and a multiplicity of closely spaced reflective embossments on said rear surface.

8. The holder of claim 1 having sufficient rigidity so that it can be supported in a substantially upright position by a stand.

9. A collectible cards protectively anchored within a holder that enhances the appearance of both sides of the card, said holder comprising:

a) a jacket formed from two identical sheets of semi-rigid non-breakable transparent plastic bounded by four straight edges in a rectangular configuration elongated upon a center axis, said sheets disposed one atop the other and sealed together along three edges by bonding to intervening spacer strips of uniform thickness disposed contiguously with said edges and parallel thereto, whereby the unsealed fourth edges define an entrance opening of an enclosure bounded by said spacer strips and sheets, and b) an insert member comprised of a piece of sheet material slidably insertable through said opening, having a thickness and outer perimeter adapted to fill said enclosure, and having a substantially centered aperture of elongated rectangular configuration having a long axis disposed coaxially with the center axis of the jacket.

* * * * *